US006503093B1

(12) United States Patent
Sakata et al.

(10) Patent No.: US 6,503,093 B1
(45) Date of Patent: Jan. 7, 2003

(54) CIRCUIT BOARD ELECTRICAL CONNECTOR

(75) Inventors: Tsuyoshi Sakata, Tokyo (JP); Satoshi Watanabe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 792 days.

(21) Appl. No.: 08/896,055

(22) Filed: Jul. 17, 1997

(30) Foreign Application Priority Data

Jul. 31, 1996 (JP) ..... 8-216882

(51) Int. Cl.[7] ..... H01R 13/62
(52) U.S. Cl. ..... 439/328; 439/160
(58) Field of Search ..... 439/325, 327, 439/328, 152, 153, 159, 160

(56) References Cited

U.S. PATENT DOCUMENTS 5,389,000 A * 2/1995 DiViesti et al. ..... 439/328
5,443,394 A * 8/1995 Billman et al. ..... 439/328
5,571,025 A * 11/1996 Arai et al. ..... 439/160

FOREIGN PATENT DOCUMENTS

JP 2-052278 4/1990
JP 6-196230 7/1994
JP 7-036378 7/1995
JP 7-288153 10/1995
JP 7-288154 10/1995
JP 7-302644 11/1995

* cited by examiner

*Primary Examiner*—P. Austin Bradley
*Assistant Examiner*—Ross Gushi
(74) *Attorney, Agent, or Firm*—Kanesaka & Takeuchi

(57) ABSTRACT

A circuit board electrical connector includes a connector housing (20) having a front edge holding section (21) with a receiving groove (23) for receiving a leading edge of a circuit board (1) having a plurality of contact pads (2) on the leading edge and an aperture or notch (3) therein, and a pair of guiding sections (22) extending upward from opposite ends of the front edge holding section for guiding the circuit board; a plurality of contact elements (25) provided in the receiving groove for contact with the contact pads of the circuit board; a pair of insertion slots (28) provided in the guiding sections and having a width slightly greater than a thickness of the circuit board; at least one pair of pressure portions (29A) provided on opposed faces of one of the insertion slots such that a distance between the pressure portions is slightly less than the thickness of the circuit board so as to hold the circuit board between them; and at least one pair of engaging projections (29B) provided on the pressure portions for engagement with the notch or aperture of the circuit board when the circuit board is inserted in the receiving groove.

2 Claims, 11 Drawing Sheets

CIRCUIT BOARD ELECTRICAL CONNECTOR

BACKGROUND OF THE INVENTION

1. Field of the Invention

The present invention relates to electrical connectors for circuit boards.

2. Description of the Related Art

An electrical connector with a receiving groove having contact elements so that when it receives a circuit board with contact pad on its leading edge, the contact elements are brought into contact with the contact pads is well known. Such an electrical connector generally has a pair of guide sections for guiding the circuit board to prevent the circuit board from tilting.

Japanese patent application Kokai No. 288153/95 discloses such an electrical connector. This connector includes a connector housing which has a front edge holding section with a receiving groove for receiving a leading edge of a circuit board and a pair of guiding sections extending upward from opposite ends of the front edge holding section for guiding the circuit board. A plurality of contact elements are disposed in the front edge holding section so that when the circuit board is inserted, they are brought into contact with the contact pads of the circuit board. The guiding sections have grooves having a width slightly greater than the thickness of the circuit board so as to receive the side edges of the circuit board for guiding the circuit board to a predetermined position. A pair of projections are provided on opposed faces of the grooves so as to engage a aperture of the circuit board for lock when the circuit board is inserted to the predetermined position.

However, the circuit board can fall off from the connector when it receives a vibration or impact. In order to solve this problem, it has been proposed that the guiding grooves be narrowed so as to hold the circuit board. However, this makes it difficult to insert the circuit board in the connector.

Accordingly, it is an object of the invention to provide a circuit board electrical connector which is able to hold a circuit board at a predetermined position against vibrations or impacts.

According to the invention there is provided a circuit board electrical connector which includes a connector housing having a front edge holding section with a receiving groove for receiving a leading edge of a circuit board having a plurality of contact pads on the leading edge and an aperture or notch therein, and a pair of guiding sections extending upward from opposite ends of the front edge holding section for guiding the circuit board; a plurality of contact elements provided in the receiving groove for contact with the contact pads of the circuit board; a pair of insertion slots provided in the guiding sections and having a width slightly greater than a thickness of the circuit board; at least one pair of pressure portions provided on opposed faces of one of the insertion slots such that a distance between the pressure portions is slightly less than the thickness of the circuit board so as to hold the circuit board between them; and at least one pair of engaging projections provided on the pressure portions for engagement with the notch or aperture of the circuit board when the circuit board is inserted in the receiving groove.

The circuit board is inserted into the predetermined position while abutting one only the engaging projections of the guiding section and expanding the insertion slots. When the circuit board is inserted in the predetermined position, the engaging projections of the guiding section enter the aperture or notch of the circuit board to prevent coming off of the circuit board. When the engaging projections enter the aperture or notch, the insertion slots return to the original width, permitting the pressure portions to hold the circuit board between them.

If vibrations or impacts are applied to the electrical connector or the circuit board, they are absorbed by the pressure portions, thus preventing coming off of the circuit board. If a pull is applied to the circuit board, in addition to the engagement by the engaging projections, the friction at the pressure portions prevents coming off of the circuit board. The engaging projections abut against the lower edge of the aperture or notch of the circuit board to prevent the coming off of the circuit board.

DESCRIPTION OF THE PREFERRED EMBODIMENT

Figure 1:
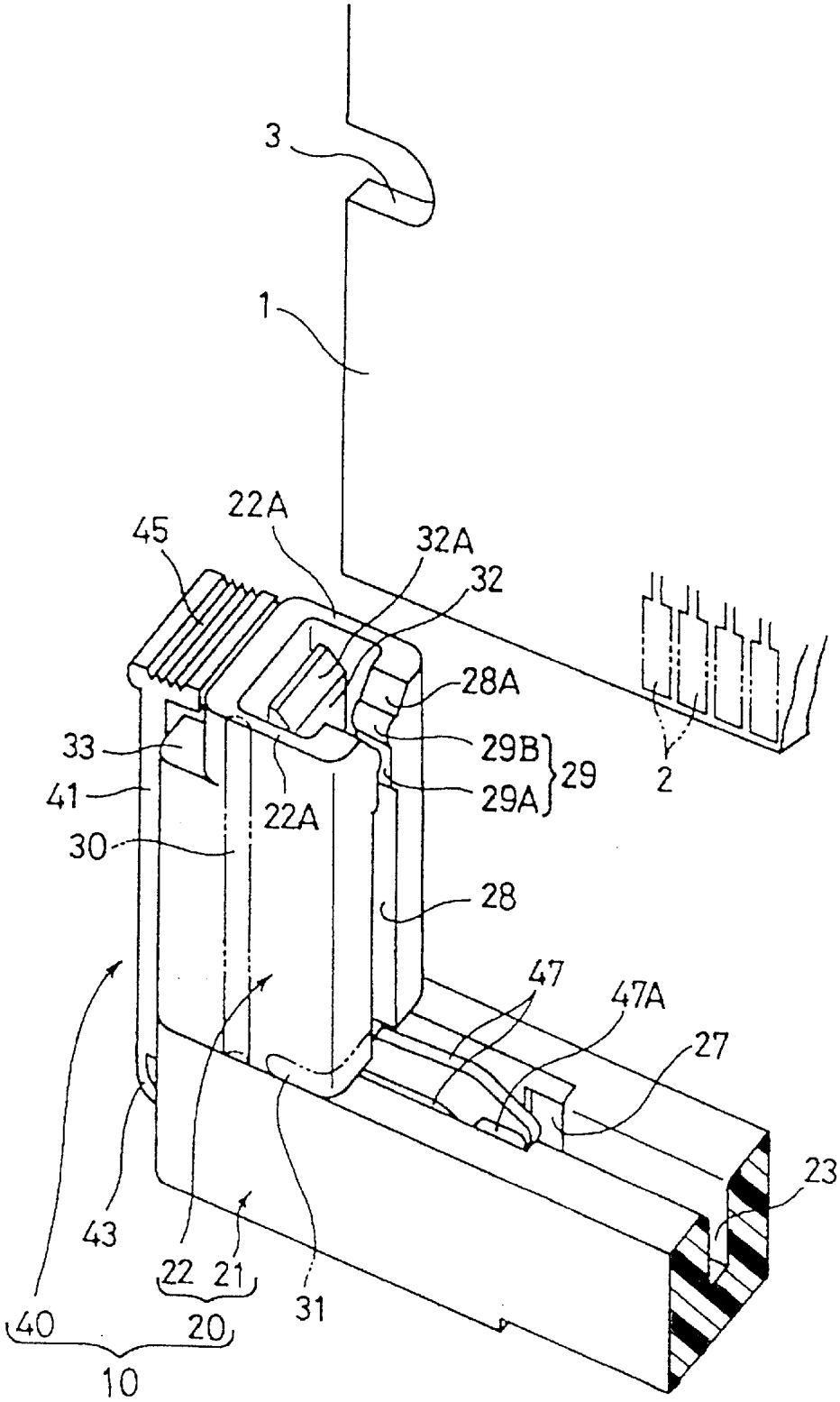
FIG. 1 is a perspective view of an electrical connector according to an embodiment of the invention.

In FIG. 1, a circuit board 1 is to be inserted into an electrical connector 10. A plurality of contact pads 2 are arranged on a leading edge of the board with a predetermined pitch. A pair of notches 3 are provided in opposite side edges of the circuit board 1. Alternatively, the notches 3 may be replaced by apertures.

The electrical connector 10 includes a connector housing 20 made from an insulation material so as to hold the circuit board 1 and an ejector unit 40 for lifting the circuit board 1 to a predetermined position.

The connector housing 20 has an elongated front edge holding section 21 and a pair of guiding sections 22 extending upward from opposite ends of the holding section 21.

Figure 2:
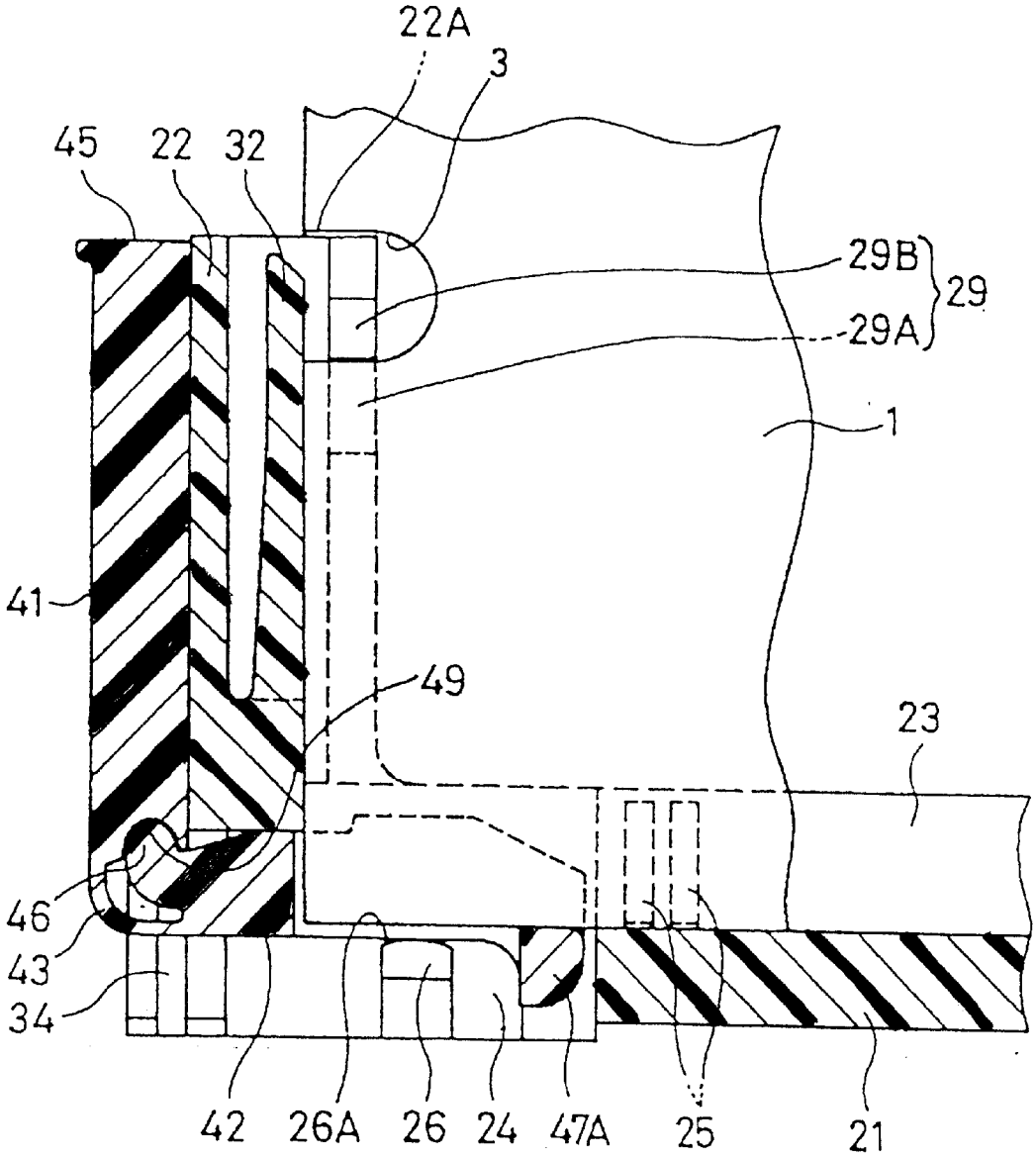
FIG. 2 is a sectional view of the electrical connector.

In FIG. 2, a receiving groove 23 is provided in the holding section 21 in the longitudinal direction. A pair of openings 24 are provided at opposite ends of the holding section 21. A plurality of contact elements 25 are arranged in the receiving groove 23 between the openings 24 such that when the circuit board 1 is inserted into the receiving groove 23, they are brought into contact with the contact pads 2 of the circuit board 1.

In FIG. 1, an insertion slot 28 is provided in the guiding section 22 so that the guiding section 22 has a C-shaped cross-section. The insertion slot 28 has a width slightly larger than the thickness of the circuit board 1 and communicates with the receiving groove 23 so as to guide the circuit board 1 into the receiving groove 23.

A pair of side edge holding sections 29 are provided on opposed face of the insertion slot 28. Each side edge holding section 29 consists of a pressure portion 29A and an engaging projection 29B. The engaging projection 29B is provided at a position such that when the circuit board 1 is inserted, it enters the notch 3 of the circuit board 1. The distance between the pressure portions 29A is set to be slightly smaller than the thickness of the circuit board 1. The press portions 29A have a flat top face but may have parallel vertical ridges.

The engaging projections 29B extend from the press portions 29A into the groove and have a size so as to enter the notch 3 of the circuit board 1. They have a semi-circular cross-section but may have other shapes. The upper corners of the insertion slot 28 are cut in a V-shape to facilitate insertion of the circuit board 1. The pressure portions 29*a* and the engaging projections 29B may be provided on only one side of the insertion slot 28. The pressure portions 29A may be provided above the engaging portions 29B or both above and below the engaging portions 29B.

The arm portions 22A of the guiding section 22 are made thinner than the other parts to make the insertion slot 28 elastic so that when the circuit board 1 is inserted into the insertion slot 28, the insertion slot 28 is resiliently expanded. In order to facilitate the resilient expansion, an indentation 30 is provided in the arm portion 22A, and a cut-out 31 is provided between the front edge holding section 21 and the arm portion 22A.

A resilient guiding plate 32 is provided within the guiding section 22. The lower base section of the guiding plate 32 is connected to the arm portion 22A of the guiding section 22 such that the upper section is flexible in the direction of the thickness of the guiding plate 32. The guiding plate 32 is in a sliding relationship with the circuit board 1 and is resiliently flexed outwardly by the circuit board 1. The upper inside corner of the guiding plate 32 has a tapered face 32A to facilitate insertion of the circuit board 1. The fixed wall of the guiding section 22 prevents excessive flexure of the guiding plate 32.

Figure 3:
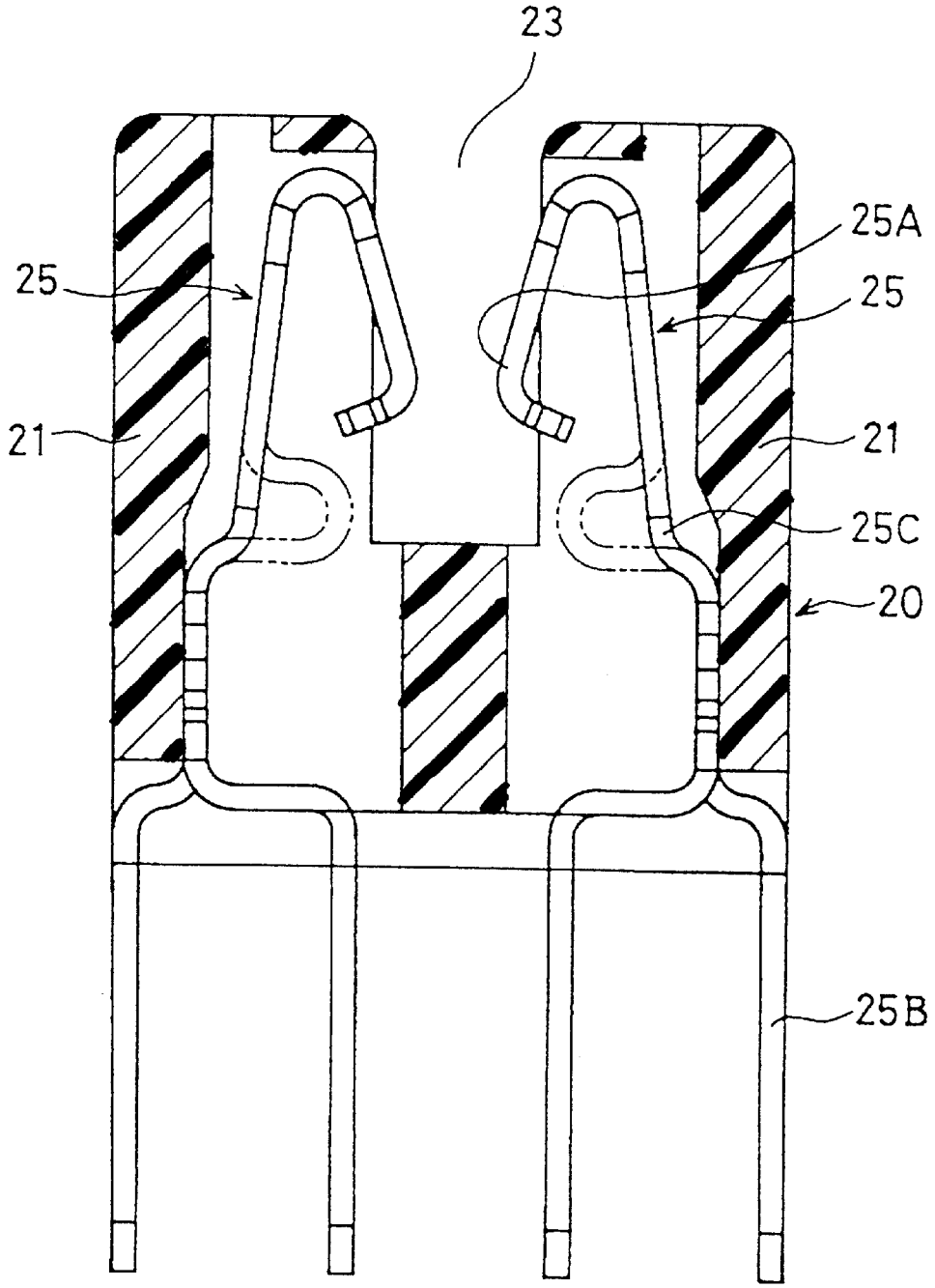
FIG. 3 is a sectional view of the electrical connector taken in a plane perpendicular to that of FIG. 2.

In FIG. 3, a plurality of contact elements are opposed to each other so as to contact both sides of the circuit board. The contact elements 25 are arranged in the direction perpendicular to the sheet and have a contact section 25A projecting into the receiving groove 23 and a connection section 25B extending downward from the connector housing 20. An intermediate section 25C connects the contact and connection sections 25A and 25B. As shown by a phantom line, the conventional contact element has a U-shaped portion, but the contact element according to the embodiment has a substantially straight portion so that the distance between the contact and connection sections 25A and 25B is minimized, and the delay or cross-talk of high speed signals is minimized.

In FIG. 1, a raised section 33 is provided on the back of the guiding section 22 and has an ejector groove 34 extending between the upper and lower ends of the raised section 33.

Figure 4:
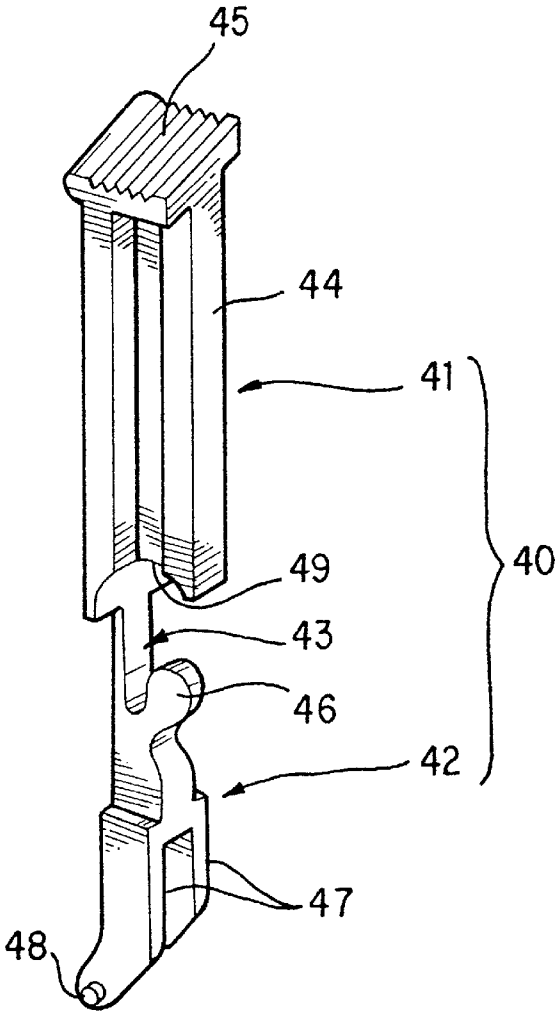
FIG. 4 is a perspective view of an ejector unit for the electrical connector.

In FIG. 4, an ejector unit 40 to be inserted into the ejector groove 34 of the guiding section 22 has a sliding section 41, a finger section 42, and a flexible linking section 43, all of which are formed integrally. Alternatively, the sliding and finger sections 41 and 42 may be made separately and then joined by the liking section.

A raised section 44 is provided on the sliding section 41 so as to be inserted in the ejector groove 34. A pressure portion 45 is provided on the top of the sliding section 41 for applying a pressure. The pressure portion 45 is corrugated to prevent slipping of fingers upon applying a pressure.

A substantially cylindrical bearing portion 46 extends obliquely upward from the finger section 42. A pair of tine portions 47 are provided below the bearing portion 46 and linked at the lower ends. A stopper projection 48 is provided on the outside end of the tine portion 47. A curved face 49 is provided on the lower end of the sliding section 41 so as to receive the bearing portion 46 when the ejector unit 40 is bent at the linking section 43.

Figure 5:
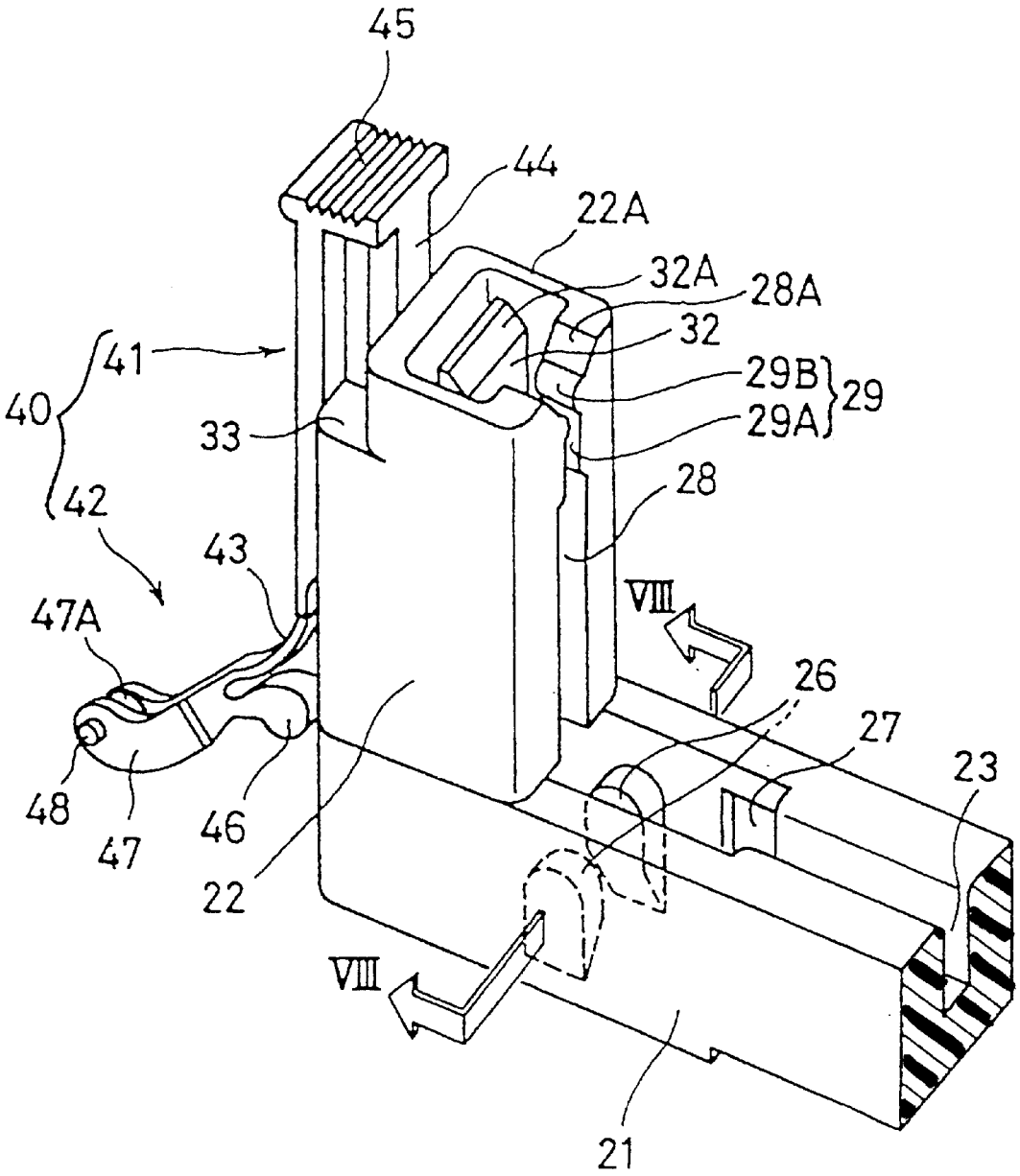
FIG. 5 is a perspective view of the electrical connector in which the ejector unit is being attached to the connector housing.

How to attach the ejector unit 40 to the connector housing 20 is as follows:

(a) In FIG. 5, the raised section 44 of the ejector unit 40 is inserted into the ejector groove 34 of the guiding section 22, with the finger section 42 is bent outwardly at the linking section 43 to facilitate the insertion. A pair of fulcrum projections 26 are provided on opposed walls of the opening 24. They have a tapered lower face and a rounded top face 26A. An engaging recess 27 extends downward in the wall of the opening 24 on the inner side (toward contact elements) with respect to the fulcrum projections 26.

Figure 6:
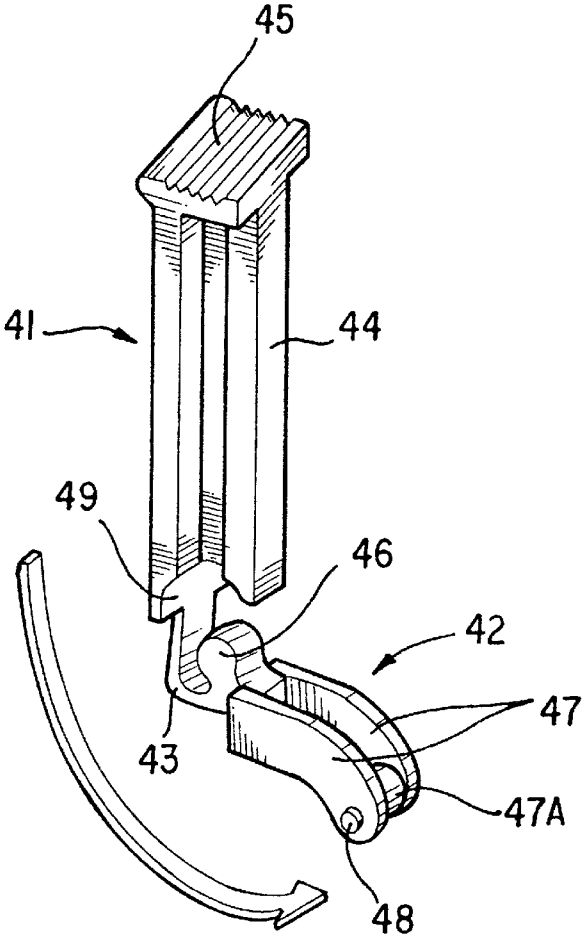
FIG. 6 is a perspective view of the ejector unit with its finger section bent at the linking section.

(b) In FIG. 6, after the raised section 44 is inserted in the ejector groove 34, the finger section 42 is bent toward the connector housing.

Figure 9:
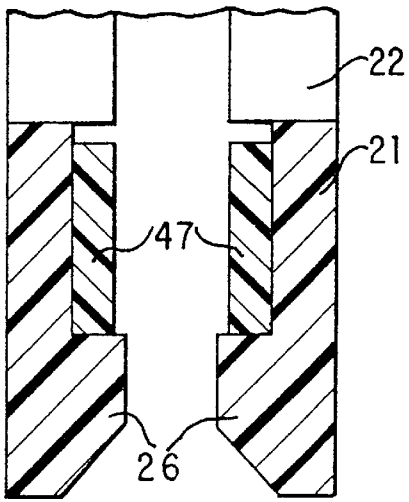
FIG. 9 is a sectional view of the finger section resting at a predetermined position in the connector housing.
Figure 8:
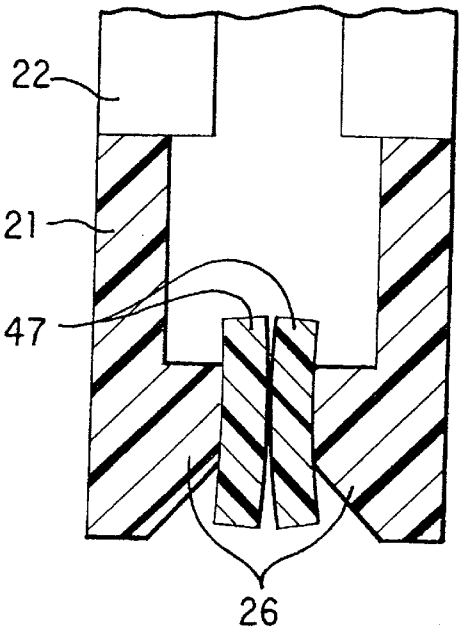
FIG. 8 is a sectional view taken along line VIII—VIII of FIG. 5, showing the finger section about to pass the projections of the connector housing.
Figure 7:
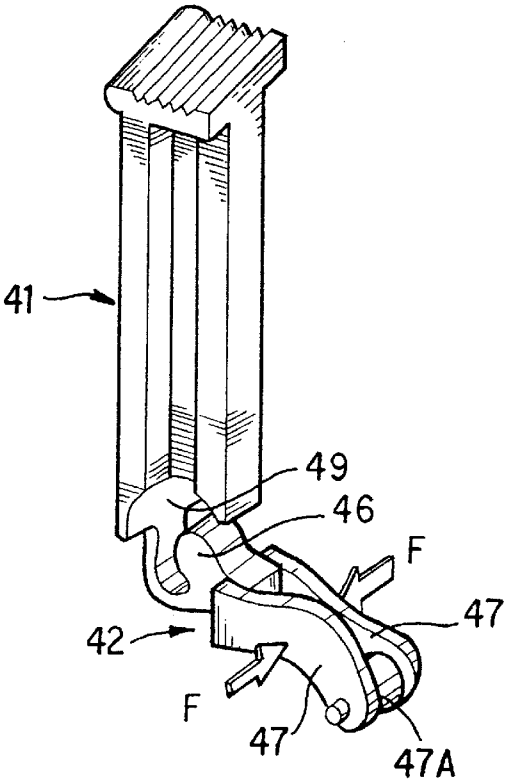
FIG. 7 is a perspective view of the ejector unit with its finger section elastically deformed.

(c) Consequently, the finger section 42 is housed in the opening 24 of the holding section 21. As FIGS. 7 and 8 show, the tine portions 47 of the finger section 42 undergo elastic deformation between the projections 26, which have a tapered lower face, and pass the projections 26. Then, as FIG. 9 shows, the tine portions 47 rest in a space defined by the projections 26 and the bottom faces of the guiding section 22. At the same time, the projection 48 of the tine portion 47 is received by the engaging recess 27 of the front edge holding section 21.

(d) As FIG. 2 shows, the bearing portion 46 of the finger section 42 is received by the curved face 49 of the sliding section 41.

(e) This completes the assembling of the electrical connector and ready to receive a circuit board.

Figure 10:
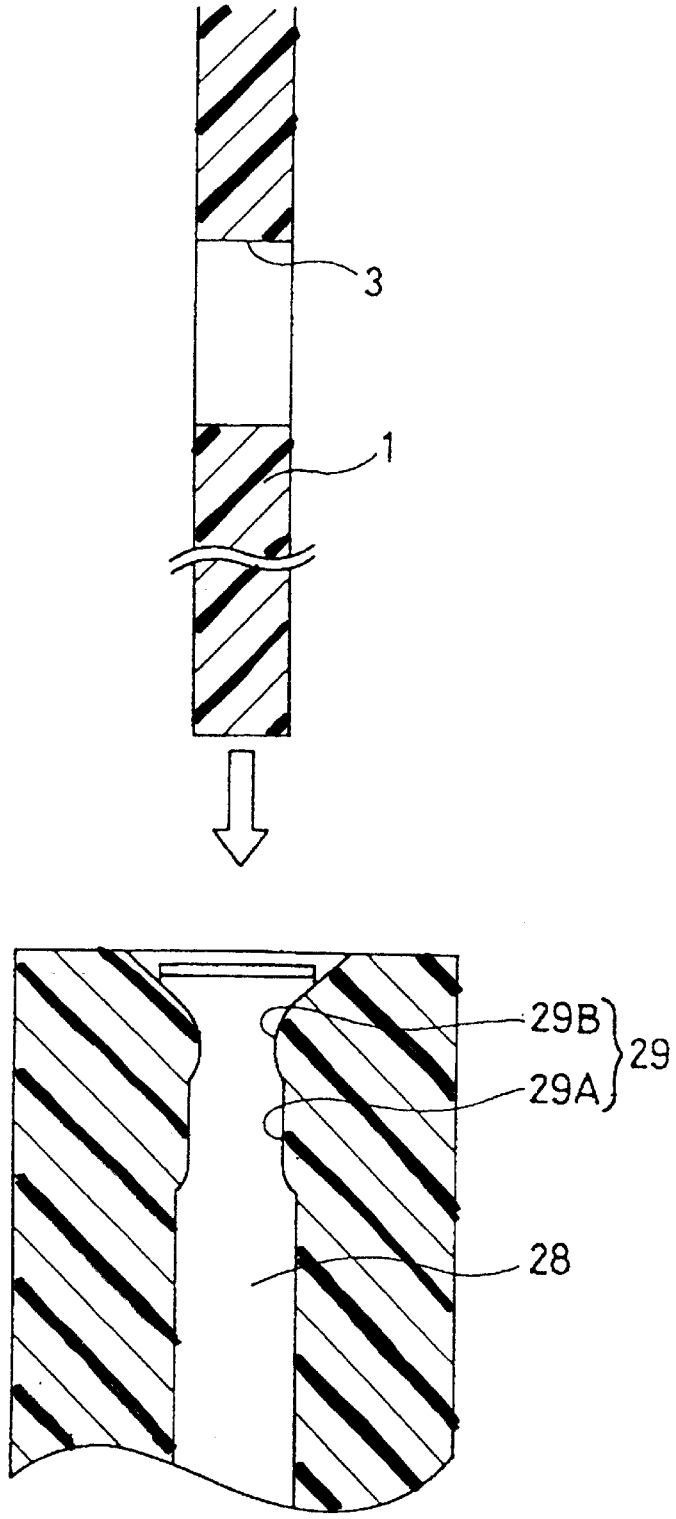
FIG. 10 is a sectional view of a circuit board and a guiding section of the electrical connector.

How to plug in and out a circuit board from the electrical connector is as follows:

(1) In FIG. 1, the circuit board 1 is inserted into the insertion slots 28 of the guiding section 22 and guided by the guiding plates 32 and the slots 28 into a predetermined position. As FIG. 10 shows, the circuit board 1 first abuts on the engaging projections 29B and expands the slots 28 during its advance. The width of the slots 28 is made slightly larger than the thickness of the circuit board 1 so that the circuit board 1 advances without difficulty.

Figure 11:
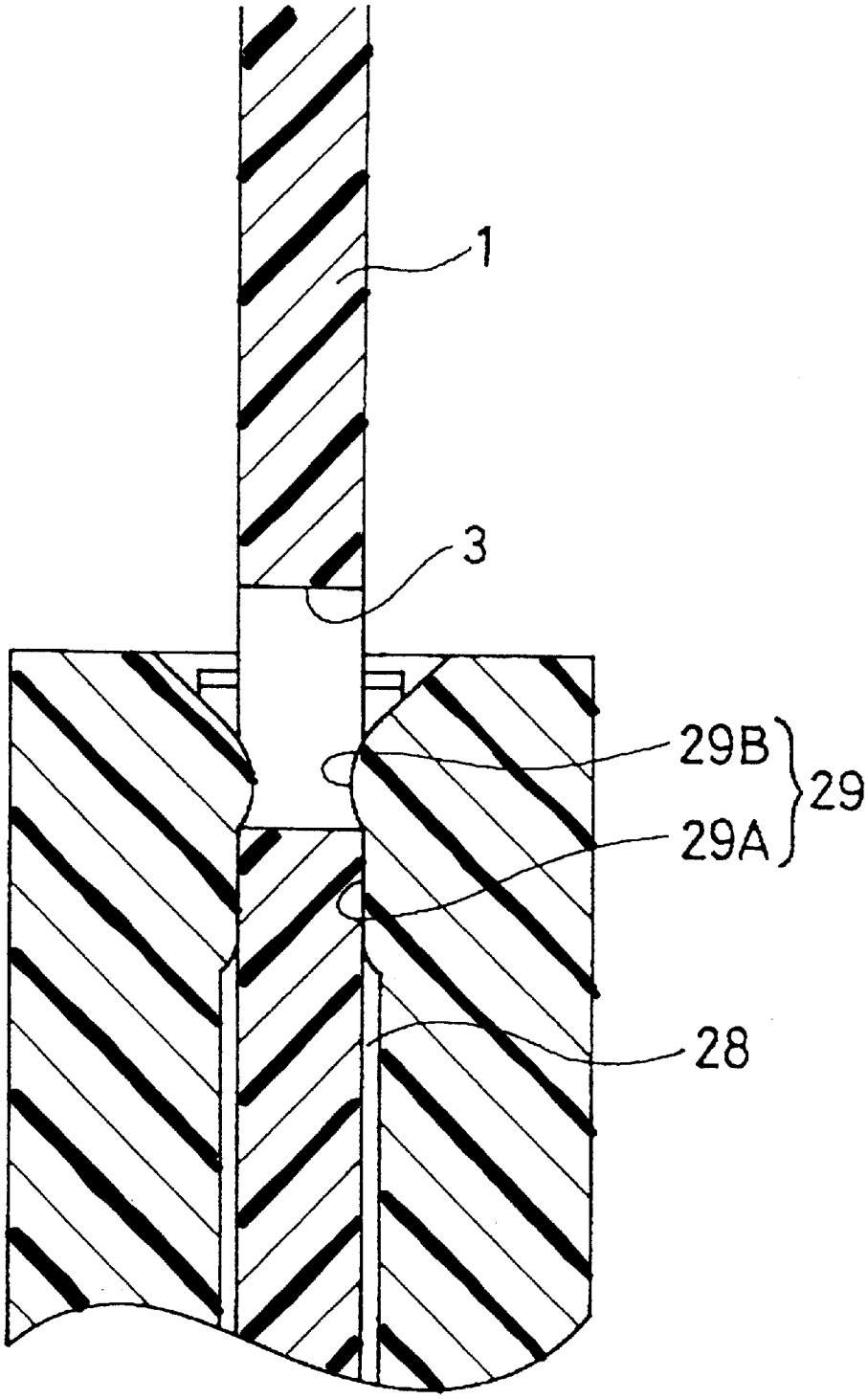
FIG. 11 is a sectional view of the circuit board inserted in the guiding section of the electrical connector.
Figure 12:
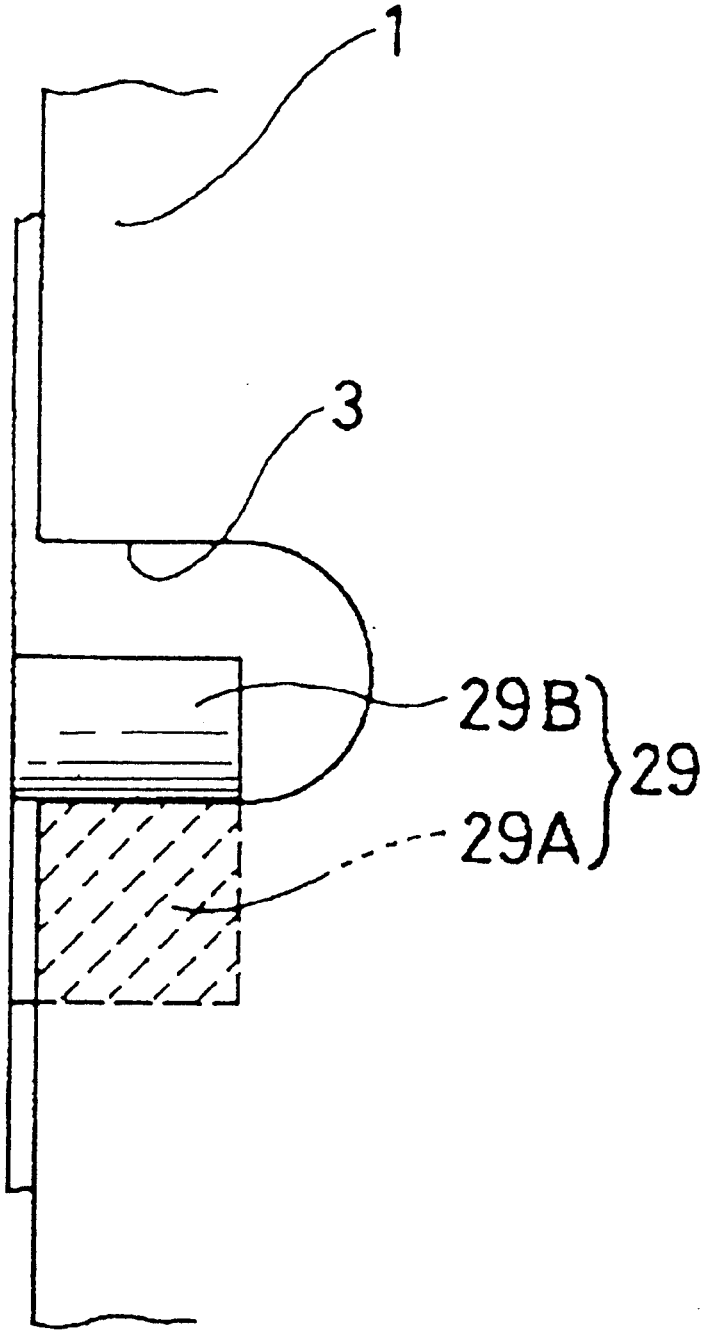
FIG. 12 is a side view of the guiding section with an edge holding portion and a notch of the circuit board.
Figure 13:
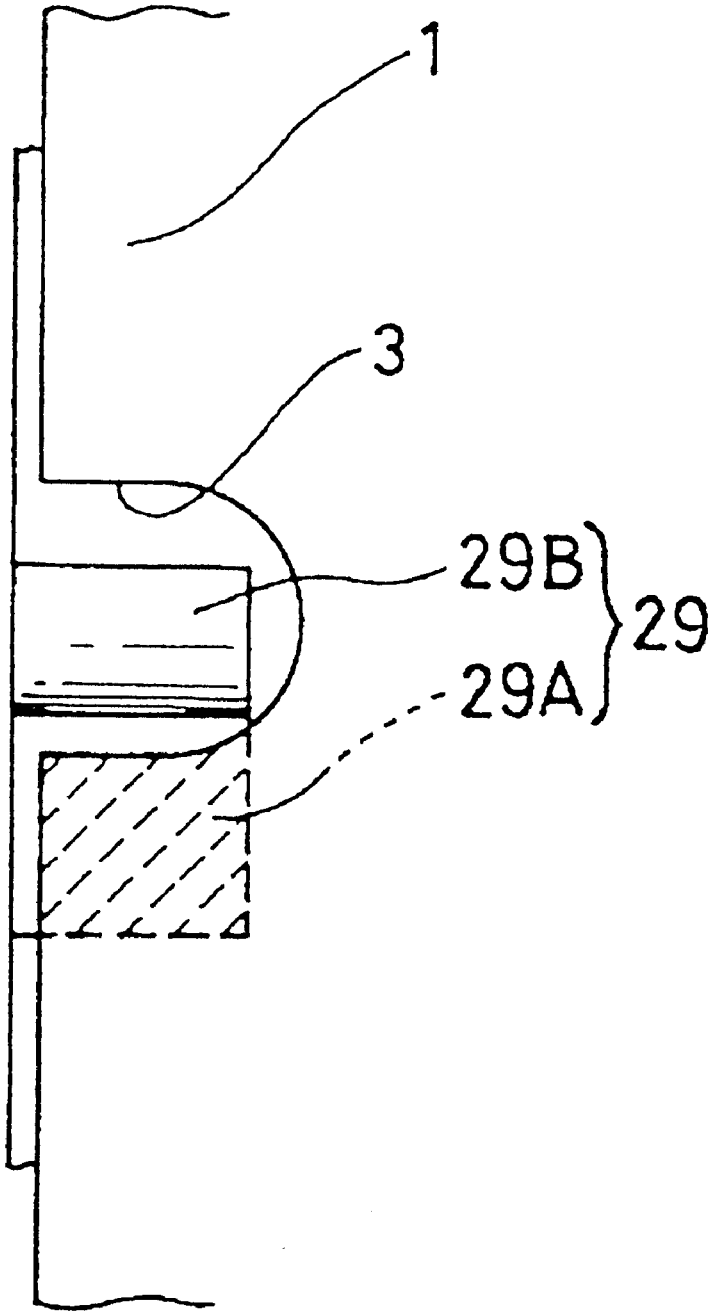
FIG. 13 is a side view of the guiding section with the edge holding portion and the notch of the circuit board.

(2) When the circuit board 1 is inserted to the predetermined position, the contact pads 2 of the circuit board 1 are brought into contact with the contact elements 25 while, as FIGS. 11 and 12 show, the engaging projections 29B of the guiding section 22 enter the notch 3 of the circuit board 1, which is held between the pressure portions 29A. As FIG. 13 shows, even if the position of the notch 3 is offset from the normal position, the engaging projections 29B are able to enter the notch 3. If a vibration or impact is applied to the electrical connector or circuit board, it is absorbed by the area hatched in FIG. 12 or 13 where the circuit board 1 is held between the pressure portions 29A. If an upward force is applied to the circuit board 1, the circuit board 1 does not come off because the notch 3 engages the engaging projections 29B.

Figure 14:
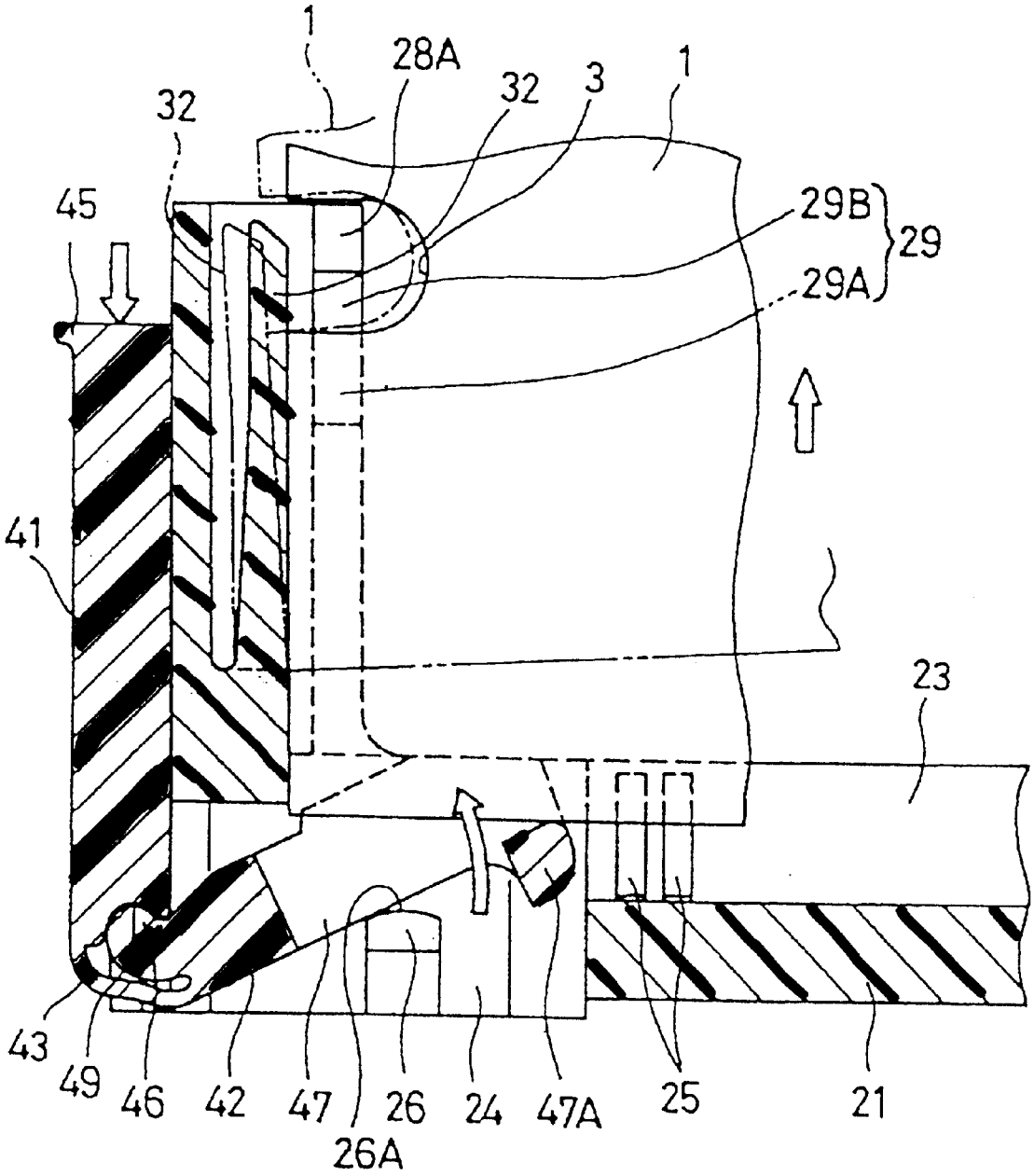
FIG. 14 is a sectional view of the electrical connector with the circuit board being removed.

(3) In order to plug out the circuit board 1, it is necessary to release the connection between the circuit board 1 and the contact elements. This is done by the ejector unit 40. As FIG. 14 shows, the press portion 45 of the ejector unit 40 is depressed to lower the sliding section 41 along the ejector groove 34.

(4) The curved face 49 of the sliding section 41 pushes down the bearing portion 46 of the finger section 42. Since the finger section 42 is supported by the projections 26, the linked portion 47A of the tine portions 47 is moved upward to lift the circuit board 1, thereby releasing the connection between the circuit board 1 and the contact elements 25. As the finger section 42 rotates about the projections 26, the contact point between the finger section 42 and the projections 26 moves to the left so that the length of arm of the moment acting on the circuit board 1 gradually increases. This is desirable because, first, the length of arm is short to provide a sufficient force to release the connection and then a larger length of movement, with a less force, of the circuit board.

The projection 48 provided on the tip of the finger section 42 abuts against the engaging recess 27 of the holding section 21 to control the rotation of the finger section 42.

(5) The connection is now released so that it is possible to pull up the circuit board 1. As shown by phantom line in FIG. 14, if the circuit board 1 is tilted, the guiding plate 32 is flexed resiliently and tends to correct the tilting.

(6) When the connection between the circuit board 1 and the contact elements is released, the finger section 42 is returned to the original or horizontal position by the spring force of the linking section 43 to push up the sliding section 41 to the original position. It is preferred to provide an engaging means, such as a projection, between the sliding section 41 and the ejector groove 34 to control the upward movement, beyond the original position, of the sliding section 41.

As has been described above, the pressure portions and the engaging projections are provided on opposed faces of the insertion slots so that if vibrations or impacts are applied to the circuit board, they are absorbed by the pressure portions to thereby minimize coming off of the circuit board. If an accidental pull is applied to the circuit board, the engaging projections prevent the circuit board from coming off from the electrical connector. The width of the insertion slots is made slightly larger than the thickness of the circuit board so that insertion of the circuit board is made without difficulty.

What is claimed is:

1. A circuit board electrical connector comprising:

a connector housing having a front edge holding section with a receiving groove for receiving a leading edge of a circuit board having a plurality of contact pads on said leading edge and a notch or aperture therein, and a pair of fixed guiding sections extending upward from opposite ends of said front edge holding section for guiding said circuit board;

a plurality of contact elements provided in said receiving groove for contact with said contact pads of said circuit board;

said guiding sections each having a pair of arm portions to provide said guiding sections with a C-shaped cross-section, ends of said arm portions having opposed faces to form an insertion slot which has a width slightly greater than a thickness of said circuit board;

at least one pair of pressure portions provided on said opposed faces of said insertion slot such that a distance between said pressure portions is slightly less than said thickness of said circuit board so as to hold said circuit board between said pressure portions; and at least one pair of engaging projections provided on said pressure portions for engagement with said notch or aperture of said circuit board when said circuit board is inserted in said receiving groove.

2. A circuit board electrical connector according to claim 1, wherein said pressure portions are provided with faces which holds said circuit board at least part of a periphery of said aperture or notch.

* * * * *